United States Patent [19]

Bonaguidi

[11] 4,425,746

[45] * Jan. 17, 1984

[54] INVERTED ROOF SYSTEM

[76] Inventor: Orland H. Bonaguidi, 1363 Cottontail La., La Jolla, Calif. 92037

[ * ] Notice: The portion of the term of this patent subsequent to Jun. 16, 1998 has been disclaimed.

[21] Appl. No.: 273,864

[22] Filed: Jun. 15, 1981

Related U.S. Application Data

[63] Continuation-in-part of Ser. No. 332, Jan. 2, 1979, Pat. No. 4,272,936.

[51] Int. Cl.[3] ..... E04B 5/00

[52] U.S. Cl. ..... 52/309.12; 52/408; 52/445

[58] Field of Search ..... 52/408, 409, 410, 411, 52/413, 445, 446, 453, 309.12, 2

[56] References Cited

U.S. PATENT DOCUMENTS

| | | | |
|---|---|---|---|
| 1,239,074 | 9/1917 | Bagnall | 52/408 |
| 2,999,041 | 9/1961 | Lappala | 52/2 |
| 3,256,229 | 6/1966 | Janota | 524/262 |
| 3,411,256 | 11/1968 | Best | 52/408 |
| 3,763,605 | 10/1973 | Freeman | 52/408 |
| 3,763,614 | 10/1973 | Hyde | 52/408 |
| 3,836,417 | 9/1974 | Le Masters | 52/2 |
| 3,892,899 | 7/1979 | Klein | 52/408 |
| 3,895,956 | 7/1975 | Yoshida | 524/189 |
| 4,045,922 | 9/1977 | Elliott | 52/408 |
| 4,077,177 | 3/1978 | Boothroyd | 52/2 |
| 4,259,817 | 4/1981 | Elliott | 52/408 |
| 4,272,936 | 6/1981 | Bonaguidi | 52/309.12 |
| 4,288,951 | 9/1981 | Carlson | 52/309.1 |

FOREIGN PATENT DOCUMENTS

| | | | |
|---|---|---|---|
| 753715 | 1/1971 | Belgium | 52/408 |

OTHER PUBLICATIONS

The Condensed Chemical Dictionary ©1956, p. 1098.

*Primary Examiner*—Henry E. Raduazo

*Attorney, Agent, or Firm*—Bruno J. Verbeck; Michael L. Slonecker

[57] ABSTRACT

A roof structure wherein a water impermeable membrane is fabricated upon a roof deck and a thermal insulation layer affixed upon the membrane. The insulation layer is thereafter coated with a suitable adhesive material and particles of inorganic particulate attached thereto, whereby a toothing surface is formed upon which is applied a mortar based insulative-protective layer. Alternatively, and in lieu of said mortar based layer, a first water impermeable layer formed of bituminous material may be disposed upon said toothing surface, followed by disposition upon said first layer of a second water impermeable layer formed of elastomeric material having radiant energy reflective material admixed therewith. Optionally, said first layer may be omitted from the roof structure and said second layer placed directly on the toothing surface.

11 Claims, 2 Drawing Figures

INVERTED ROOF SYSTEM

CROSS REFERENCE TO RELATED APPLICATIONS

This is a continuation-in-part of U.S. Ser. No. 000,332, filed Jan. 2, 1979 and now U.S. Pat. No. 4,272,936.

BACKGROUND OF THE INVENTION

The present invention relates to a new and unique variation of, and improvement over, conventional inverted roof structures. As a result of the practice of this invention, an inverted roof structure can be constructed which possesses superior fire-retardant, protective, and insulative properties, while concurrently significantly reducing the overall weight of the composite roof structure. It is an important feature of this invention that such improved structure can be constructed independent of the pitch angle the roof structure forms with the horizontal.

The method and structure of inverted roof systems is well known and practiced by members of the building profession. For example, U.S. Pat. No. 3,411,256, held by the Dow Chemical Company, (hereinafter, "Dow"), discloses an inverted roof structure, and method thereof, which comprises a roof deck, water impermeable membrane, closed cell water impermeable thermal insulating member, and a water permeable protective layer. This structure reduces exposure of the water impermeable membrane to adverse environmental conditions, thereby protecting the membrane and extending the useful like of the roof structure.

While the structure taught by Dow is now used throughout the building industry, the structure possesses several signficant limitations which renders it generally unsuitable for use under many naturally existing conditions. For example, inasmuch as the protective layer is water permeable, moisture passing therethrough ultimately contacts the underlying water impermeable membrane and can cause cracking of said membrane due to cyclical freezing and thawing conditions. Further Dow recognizes that the thermal insulation member is subject to decomposition, particularly when exposed to sunlight; however it fails to disclose a method by which the insulating member may be permanently protected from such elements. Still further, a roof structure constructed in accordance with the Dow disclosure utilizing styrene for the thermal insulation member requires approximately 1200 pounds of gravel per 100 square feet of roof surface area in order to receive an Underwriter's Laboratories Class A rating for fire retardancy. Finally, Dow fails to disclose a method by which the protective layer can be applied regardless of pitch angle, and, by necessity, structures constructed in accordance with the method of the invention are limited to low pitch angles.

Therefore, it is an object of the present invention to provide a roof structure which substantially inhibits the absorption of water which may adversely affect the water impermeable membrane.

Yet another object is to provide a protective layer which effectively inhibits deterioration of the underlying thermal insulation layer due to foot trafic and adverse environmental conditions.

A still further object is to provide a roof structure which may be constructed without roof pitch angle limitations.

And yet another object is to provide a roof structure characterized by superior insulative and fire retardant qualities while simultaneously achieving an overall reduction in the weight of the structure.

SUMMARY OF THE INVENTION

The present invention relates to a roof structure characterized by a thermal insulation layer secured to the exposed surface of a water impermeable roofing membrane. Adhesive material is thereafter applied to the exposed insulative layer surface and inorganic particles attached thereto in sufficient quantity to ensure that each particle contacts all other contiguous particles. The combination of adhesive and particulate forms what is known as a toothing surface, said surface serving as a means by which a final overlayment of inorganic mortar based compound may be secured to the roof structure. The final overlayment forms a protective skin which serves to retard water absorption through the roof structure, protect the substrate from injury due to foot traffic, ultra-violet light and adverse weather conditions, and increase the insulative "R" factor of the composite structure. It is a unique feature of the present invention that the incorporation of the toothing surface therein permits the application of the final overlayment at any roof pitch angle from horizontal.

In an alternate form of this invention suitable for use in conditions where enhanced insulation properties are a concern secondary to construction of a light-weight roof of superior water impermeability integrity, a bituminous material-containing first water impermeable layer is substituted and used in lieu of said mortar based layer. Disposed upon said first layer is a second water impermeable layer formed of elastomeric material having radiant energy reflective material in admixture therewith.

DESCRIPTION OF THE PREFERRED EMBODIMENT

Figure 1:
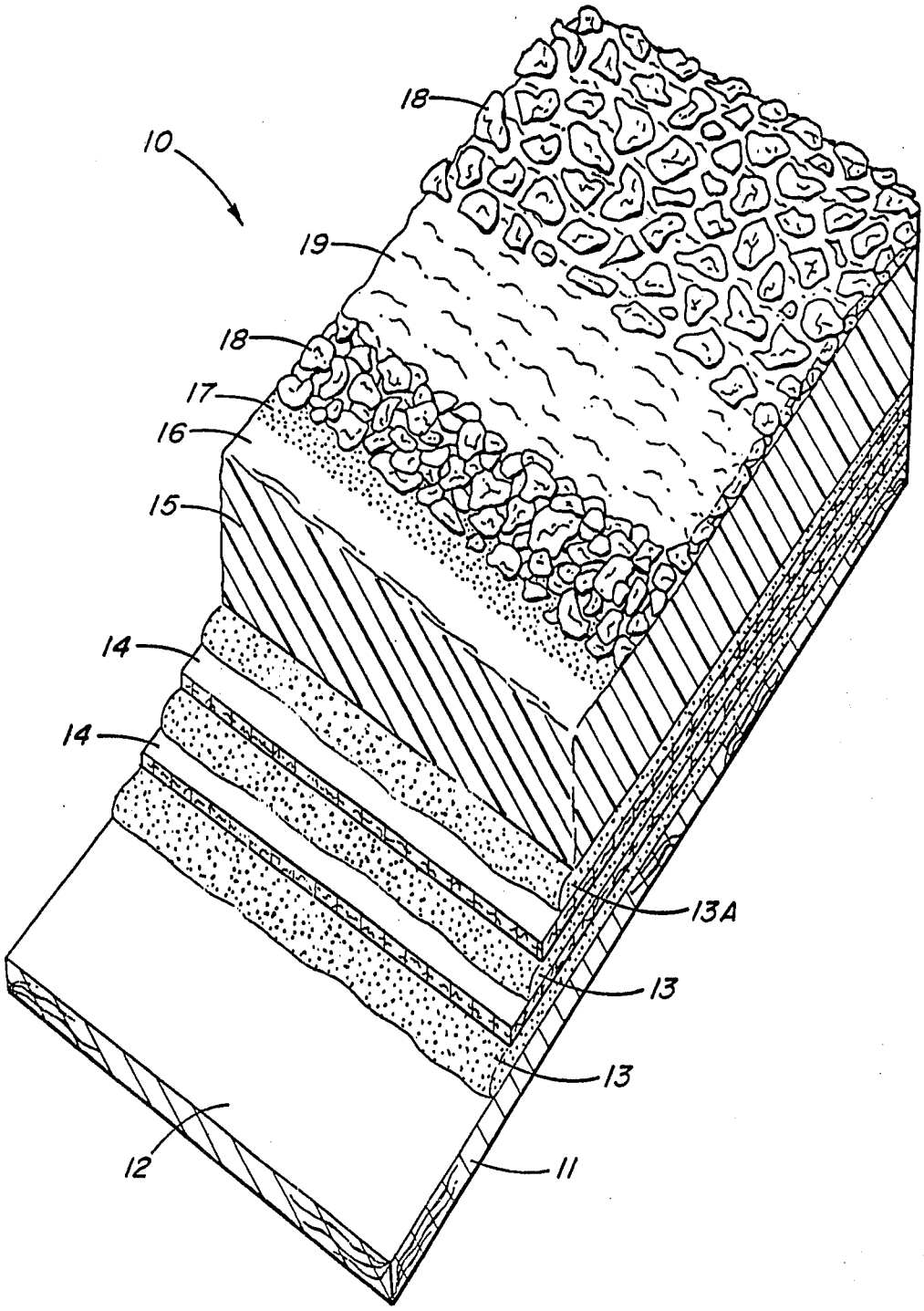
FIG. 1 is a perspective view of the preferred embodiment of this invention.

For a more complete understanding of my invention reference is now made to the several figures wherein like reference numerals refer to like parts throughout the several views, and wherein FIG. 1 illustrates an inverted roof system 10 constructed in accordance with the preferred practice of the present invention. The inverted roof system 10 comprises a roof deck 11 secured upon a multiplicity of rafters or other suitable roof support structure (not shown), said roof deck 11 having an exposed outer surface 12. A water impermeable membrane, comprising a plurality of alternating layers of adhesive 13, roofing felt 14, and a final overlayment of adhesive-sealant coat 13A is thereafter secured to the roof deck 11 such that the exposed outer surface 12 of roof deck 11 is completely covered by the water impermeable membrane. Secured upon adhesive-sealant coat 13A, the outermost layer of the membrane, is a thermal insulation layer 15 having an upper surface 16. A toothing surface is formed upon the thermal insulation layer 15 by coating the upper surface 16 of layer 15 with an adhesive 17, and thereafter partially imbedding a singular layer of inorganic particles 18 into adhesive 17. The particles 18 are applied in sufficient quantity so as to ensure that the entire exposed surface of adhesive 17 is uniformly covered with the particles 18, each particle in continuous contact with contiguous particles. Finally, a mortar based insulative-protective layer 19 is applied onto the toothing surface, thereby completing the composite structure. If aesthetically desired, additional particles 18 may be partially imbedded into layer 19 prior to its solidification.

The roof support structure, the roof deck, water impermeable membrane, and thermal insulation layer may be constructed from a wide variety of materials well known to practitioners in the building industry. For example, the water impermeable membrane may be fashioned by overlapping alternating layers of asphaltic base adhesive and roofing felt in sufficient quantity to ensure water impermeable integrity, two or three layers of each usually considered as being satisfactory.

Selection of the proper sealant-adhesive coat to be overlayed upon the water impermeable membrane depends upon the practitioner's choice of material used to form the thermal insulation layer. Beneficially, such insulation layer would be comprised of closed cell plastic foam material such as polyurethane foams, styrene polymer foams, and others well known to the art.

Inasmuch as polyurethane foams and the like are characterized by a high degree of resistance to degradation and distortion when contacted with high temperature adhesive materials such as hot asphalt, either hot process or cold process adhesives may be utilized to seal the membrane and secure the thermal insulation layer thereon.

Styrene, however, is particularly susceptible to distortion and degradation when contacted with high temperature adhesive materials; therefore, the use of a cold process, water based acrylic resin or asphaltic emulsion for the sealant-adhesive coat is desirable in order to secure the styrene material upon the underlying substrate. Adhesives such as those manufactured by Thermo Materials, Incorporated of San Diego, Calif. under the names Thermo Concentrate #101A (thermo plastic acrylic polymer) and Thermo Series 200 E (asphaltic emulsion) have proven suitable for use in bonding the styrene to the membrane.

The aforementioned limitations similarly apply to the selection of the adhesive incorporated into the toothing surface. If styrene, or other similar thermo plastic synthetic resinous material is used to form the thermal insulation layer, the adhesive must be amenable to cold process application. Alternatively, hot asphalt may be utilized as an adhesive if interposed between the styrene and the adhesive is a protective layer of saturated asphaltic felts or the like which serve to inhibit styrene degradation.

While the adhesive utilized in the toothing surface is in a plastified state, $+\frac{1}{4}$ inch, $-\frac{3}{8}$ inch gravel, applied at the rate of approximately 150 pounds gravel per 100 square feet of adhesive surface area, is partially imbedded therein in sufficient quantity to ensure contiguous particle contact over the entire adhesive surface. Where the possibility of water ponding and continuous cyclical freeze/thaw conditions are likely to occur, gravel size must be increased to $+\frac{1}{4}$ inch, $-\frac{5}{8}$ inch.

When the roof structure has been thus far completed, the final construction step consists of the preparation and application of the insulative-protective layer. Basically, the layer is comprised of an inorganic mortar based compound made up of the following ingredients in substantially the proportions stated:

| | |
|---|---|
| White cement | 51% |
| Magnesium silica or calcium carbonate flour | 38.5% |
| Perlite fines; +200, −300 mesh | 1.5% |
| Clay; +200, −300 mesh | 3.0% |
| Lime; +200, −300 mesh | 5.5% |
| Thickener | 0.2% |

The above mixture of dry powder is thereafter added in a continuous stream at the rate of 50 pounds powder to six gallons of water and agitated to ensure homogeneity. Finally, an additional one-half gallon of vinyl acrylic polymer or acrylic emulsion vehicle is added and uniformly dispersed throughout the mixture prior to ceasing agitation. The latter ingredient serves the purpose of increasing the compressive strength of the protective-insulative layer, and retards water absorption through the layer.

The ingredients disclosed in the above example will yield a white color composition. It should be understood, however, that color variation may be obtained by the addition of pigments or the like. Still further, the above example contemplates application of the mixture under moderate temperature conditions. If application is to be made at temperatures below freezing, five pounds of barium chloride per 50 pounds of dry powder may be added to accelerate prolonged setting associated with low temperature conditions.

The composition thus formed is thereafter uniformly applied with a pressure hose upon the entire toothing surface at a minimum rate of 50 pounds per 100 square feet of surface area. During application, the composition remaining to be used must undergo continuous agitation and any of the mixture not utilized within three hours of mixing must be discarded.

It is thus seen that upon solidification of the insulative-protective layer, a structure is formed possessing superior insulative, protective, and fire-retardant qualities over present state of the art structures. Further, by incorporating a toothing surface into the composite structure, a surface is formed whereby the insulative-protective layer may be secured to the roof structure without restriction due to the roof pitch angle.

Figure 2:
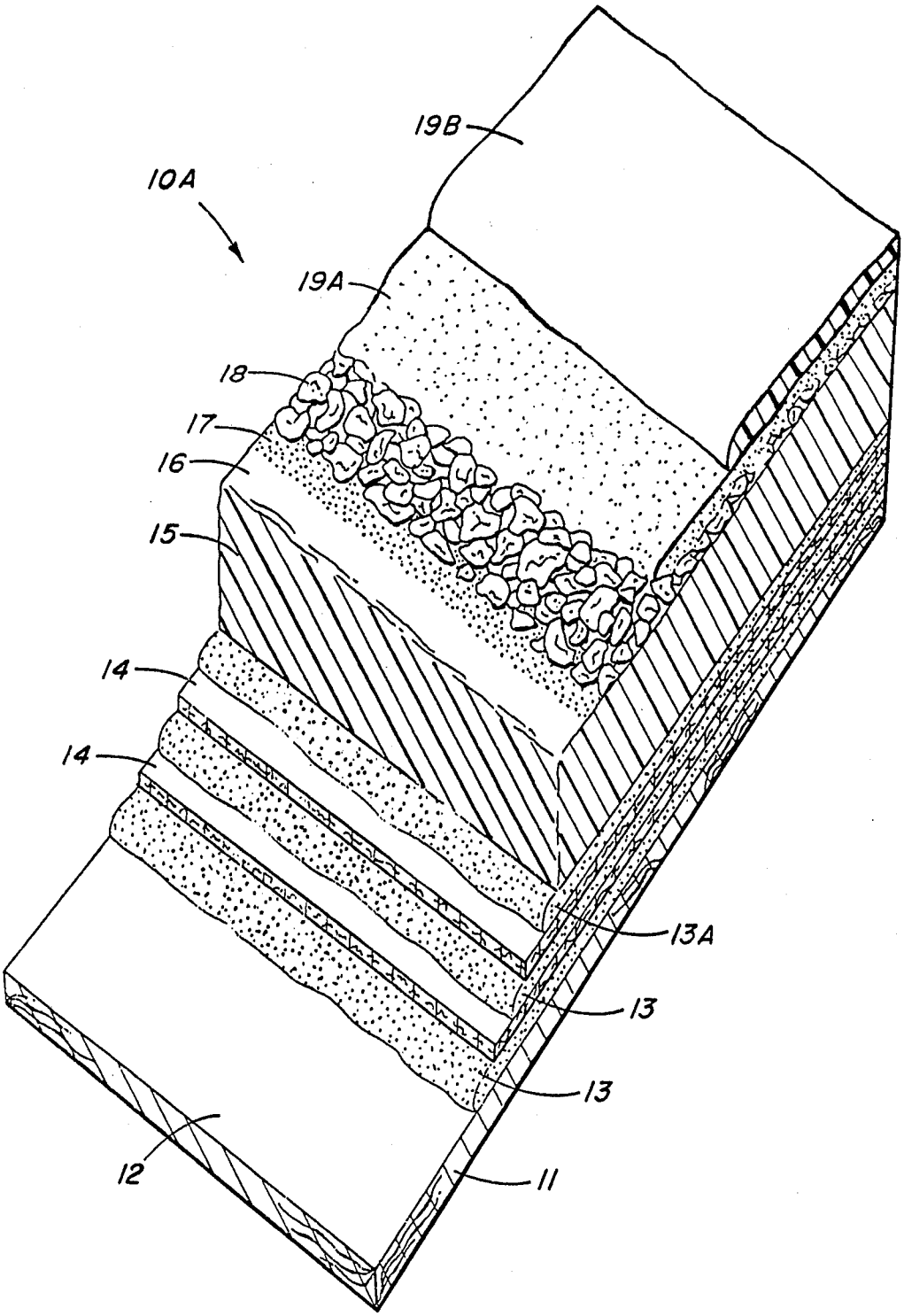
FIG. 2 is a perspective view of an alternate embodiment of the invention.

Of course, climatic conditions vary widely depending upon geographical location. In certain of those locations the need for a light-weight roof structure of superior water impermeable integrity may be of paramount importance as opposed to a roof structure including both enhanced water impermeability and insulative properties, such as a roof constructed in accordance with the practice of the preferred embodiment of this invention. Accordingly, FIG. 2 illustrates an alternate form of this invention which distinguishes from the preferred embodiment shown in FIG. 1 by the substitution for the mortar based layer of a different overlayment structure disposed upon the toothing surface. Because the roof structure of the alternate embodiment is to a large extent identical to the structure of the preferred embodiment, only the distinguishing features are discussed hereinafter.

More specifically, FIG. 2 illustrates an inverted roof system 10A having a first water impermeable layer 19A disposed over the toothing surface in an amount sufficient to cover the exposed surface portions of particles 18. Disposed over layer 19A is a second water impermeable layer 19B.

Water impermeable layer 19A is formed from conventional asphaltic or bituminous containing compositions typically employed in roofing arts. For example, hot asphalt, water-based asphaltic emulsions, and solvent-based asphaltic emulsions may be employed for forming layer 19A. In the case where particles 18 comprise gravel of about $+\frac{1}{4}$ inch, $-\frac{5}{8}$ inch mesh size applied at the rate of about 150 pounds of gravel per 100 square feet of surface area, an amount of at least about 5 gallons of the material used to form layer 19A is required per 100 square feet of surface area to ensure that the particles 18 are adequately covered and thereby protected from invasion by water.

Because water impermeable layers formed from asphaltic and bitumunous containing compositions are known to be suseptible to cracking, peeling, etc. when exposed to sunlight and/or temperature variations, the water impermeable integrity of layer 19A is enhanced against such occurences by the disposition thereupon of water impermeable layer 19B. Layer 19B is formed from an elastomer containing material which enables said layer to withstand expansion and/or contraction, due to temperature variations, without cracking, thereby protecting against water invasion of the several layers subjacent thereof. An elastomer containing material suitable for use in forming water impermeable layer 19B is the E. I. Dupont product referred to as HYPALON (a registered trademark). A suitable water impermeable layer 19B is formed upon layer 19A by applying an amount of at least about 3 gallons of said product per 100 square feet of surface area. To mitigate sunlight penetration of layer 19B, which penetration would prematurely degrade the structure of layer 19A, an effective amount of radiant energy reflective material is admixed with said product prior to its application upon layer 19A. Titanium dioxide, which results in white tint being imparted to layer 19B, is especially suitable for use as said radiant energy reflective material and results in the additional benefit of reducing heat adsorption by the inverted roof structure 10A.

As a variant of the foregoing, the elastomeric coating 19B can be placed directly on either surface 16 of layer 15 or on the toothing surface 18.

Other examples of suitable elatomers are, e.g., acrylics such as vinyl acrylic polymers, acrylic emulsions, silicones and the like.

It is understood that the above description of my invention is done to fully comply with the requirements of 35 USC 112 and not intended to limit my invention in any way. It can be seen that variant forms of my invention could easily be developed by practitioners skilled in the art. For example, the toothing surface could be eliminated from the composite structure whenever the roof pitch angle is substantially 0°. Inasmuch as this and may other variant forms of my invention are possible, such variant forms are considered to be within the scope and essence of my invention.

What is claimed:

1. An inverted roof structure, comprising:
(a) roof support means;
(b) a roof deck secured to said support means;
(c) a water impermeable membrane affixed to the exposed surface portion of said deck;
(d) a sealant-adhesive coat disposed on said membrane;
(e) a thermal-insulation layer comprised of closed-cell plastic foam disposed upon said sealant-adhesive coat;
(f) a toothing surface secured upon said thermal-insulation layer, said toothing surface comprising a layer of adhesive disposed upon said thermal-insulation layer and a plurality of particles of inorganic material partially embedded in said adhesive, said particles being in a quantity sufficient to provide substantially continuous and contiguous particle contact over substantially the entire surface of said adhesive; and
(g) an elastomeric water impermeable layer disposed over said toothing surface.

2. An inverted roof structure as set forth in claim 1 wherein said inorganic material comprises gravel of a size of about $+\frac{1}{4}$ inch, $-\frac{5}{8}$ inch mesh.

3. An inverted roof structure as set forth in claim 1 wherein said elastomeric water impermeable layer further comprises radiant energy reflective material in admixture therewith and in an amount sufficient to reduce radiant energy adsorption by said layer.

4. An inverted roof structure as set forth in claim 3 wherein said reflective material comprises titanium dioxide.

5. An inverted roof structure, comprising:
(a) roof support means;
(b) a roof deck secured to said support means;
(c) a water impermeable membrane affixed to the exposed surface portion of said deck;
(d) a sealant-adhesive coat disposed upon said membrane;
(e) a thermal-insulation layer comprised of closed-cell plastic foam disposed upon said sealant-adhesive coat;
(f) a toothing surface secured upon said thermal-insulation layer; and
(g) a water impermeable first layer disposed over said toothing surface in an amount sufficient to cover said toothing surface, said first layer comprising bituminous material.

6. An inverted roof structure as set forth in claim 5 wherein said toothing surface comprises an adhesive disposed upon said thermal-insulation layer and a plurality of particles of inorganic material partially embedded in said adhesive, said particles being in a quantity sufficient to provide substantially continuous and contiguous particle contact over substantially the entire surface of said adhesive.

7. An inverted roof structure as set forth in claim 6 wherein said inorganic material comprises gravel of a size of about $+\frac{1}{4}$ inch, $-\frac{5}{8}$ inch mesh, and wherein said bituminous material is disposed over said gravel in an amount of at least 5 gallons per 100 square feet of surface area.

8. An inverted roof structure as set forth in claim 5, further comprising a water impermeable second layer disposed over said first layer, said second layer comprising an elastomeric material.

9. An inverted roof structure as set forth in claim 8 wherein said second layer is formed from a settable liquid which is disposed as a liquid over said first layer in an amount of at least about 3 gallons per 100 square feet of surface area.

10. An inverted roof structure as set forth in claim 8 wherein said second layer further comprises radiant energy reflective material in an amount sufficient to reduce radiant energy adsorption by said second layer.

11. An inverted roof structure as set forth in claim 10 wherein said reflective material comprises titanium dioxide.

* * * * *